United States Patent [19]

Honegger

[11] Patent Number: 4,676,496

[45] Date of Patent: Jun. 30, 1987

[54] METHOD AND APPARATUS FOR SUPPLYING PRINTED PRODUCTS TO A CONTINUOUSLY OPERATING PROCESSING LINE

[75] Inventor: Werner Honegger, Tann-Rüti, Switzerland

[73] Assignee: Ferag AG, Hinwil, Switzerland

[21] Appl. No.: 677,564

[22] Filed: Dec. 3, 1984

[30] Foreign Application Priority Data

Dec. 16, 1983 [CH] Switzerland ..... 6718/83

[51] Int. Cl.[4] ..... B65H 5/26; B65H 18/00

[52] U.S. Cl. ..... 271/9; 271/3.1; 271/151; 271/216; 242/55; 242/59; 221/72

[58] Field of Search ..... 271/9, 3, 3.1, 7, 8.1, 271/151, 246, 216, 198, 202, 203, 184, 225, 237; 493/434; 53/430, 118; 242/55, 59; 198/644, 778, 347; 414/32, 51, 53, 104; 221/209, 218, 185, 71, 72, 73

[56] References Cited

U.S. PATENT DOCUMENTS

| | | | |
|---|---|---|---|
| 667,604 | 2/1901 | Stockholm | 271/198 |
| 985,516 | 2/1911 | Dupont et al. | 221/72 |
| 3,522,943 | 8/1970 | Swanson | 271/6 |
| 3,945,633 | 3/1976 | Knopp | 271/3.1 |
| 4,032,038 | 6/1977 | Hendricks | 221/71 |
| 4,069,944 | 1/1978 | Achelpohl | 221/72 |
| 4,337,864 | 7/1982 | McLean | 271/207 X |
| 4,525,982 | 7/1985 | Meier | 242/59 X |
| 4,597,541 | 7/1986 | Leu | 242/55 |

*Primary Examiner*—Andres Kashnikow
*Assistant Examiner*—Matthew C. Graham
*Attorney, Agent, or Firm*—Werner W. Kleeman

[57] ABSTRACT

One stack space is provided for accommodating each stack of a plurality of stacks of printed products to be supplied to the processing line. Each stack space is provided with a powered feed mechanism which urges the associated stack toward a predetermined processing location, such as a product singling or supply device for singly transferring printed products to the processing line. To be able to prepare the supply of printed products at a location remote from or independent of the processing line, a plurality of transportable winding frames are provided. The winding frames are equipped for exchangeably accommodating a wound package of mutually identical printed products. The winding frames are provided with drive and conveying means which drive the wound package in an unwinding direction and convey the printed products unwinding from the printed package to a transfer location. The winding frames are each selectively connectible to any one of the feed mechanisms, while a drive member of the feed mechanism can be simultaneously coupled to a drive member of the drive and conveying means.

16 Claims, 4 Drawing Figures

Fig. 1
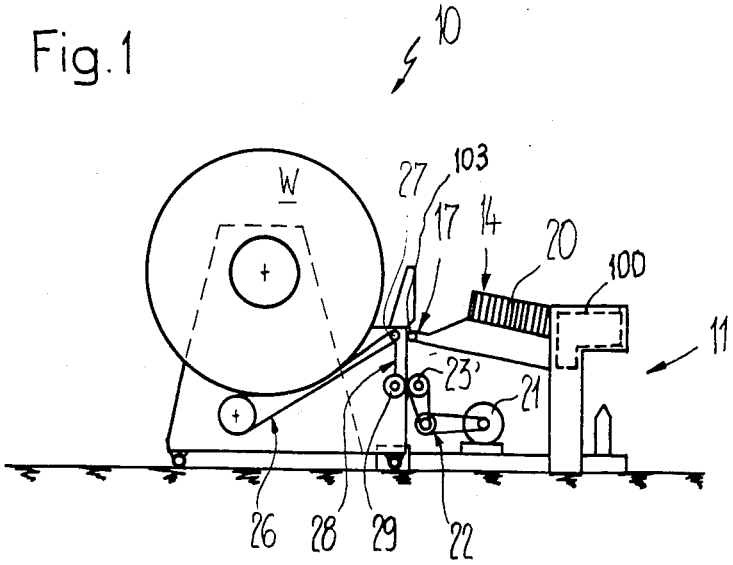
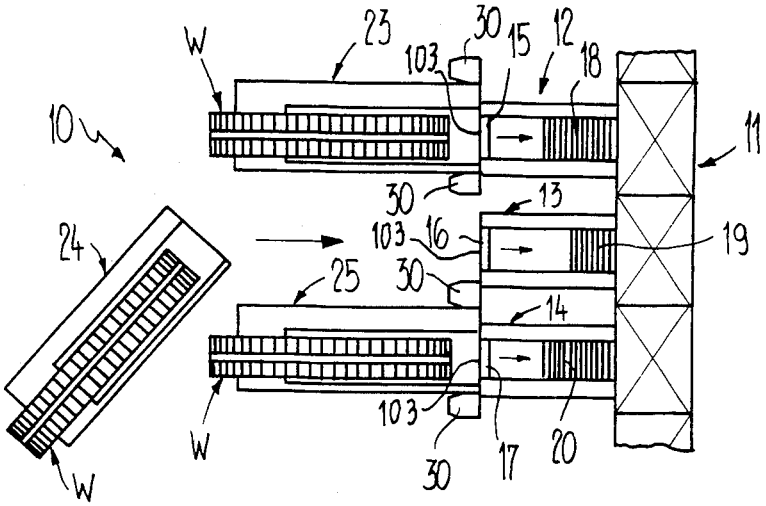
Fig. 2

METHOD AND APPARATUS FOR SUPPLYING PRINTED PRODUCTS TO A CONTINUOUSLY OPERATING PROCESSING LINE

BACKGROUND OF THE INVENTION

The present invention broadly relates to an apparatus and method for supplying printed products to a continuously operating processing line and, more specifically, pertains to a new and improved construction of an apparatus for supplying printed products to a continuously operating processing line, especially for supplying folded printed products or so-called signatures to a collator or collector device.

Generally speaking, the apparatus of the present invention comprises a plurality of stack spaces or chutes for accommodating one stack each of interrelated or mutually identical printed products or signatures to be supplied to the processing line, a supply device for transferring the printed products or signatures singly to the processing line, and a powered feed mechanism provided for each stack space or chute for feeding an associated one of the stacks to the supply device.

Such processing lines, for instance collating or assembling apparatuses, collective staplers or binders and the like, usually have a plurality of stack spaces or chutes arranged in relatively dense sequence along the processing line. These stack spaces or chutes have a relatively limited capacity and, if the continuous mode of operation is not to be interrupted, must also be refilled as soon as the supply in one of the stack spaces runs out. When there are a great number of stack spaces, this requires a considerable amount of effort even when the work is partly mechanized. In principle, the capacity of the stack spaces could be increased in order to lengthen the time interval before exhaustion of the content of a stack space. On the other hand, most stack spaces are set up to accommodate reclining stacks with standing or upright printed products or folded signatures in order to facilitate removal of individual copies from the stack. This means that an increase in the capacity of the stack space would lead to a corresponding lengthening of the stack space in the horizontal direction and therefore to an increase of the spatial requirements.

SUMMARY OF THE INVENTION

Therefore, with the foregoing in mind, it is a primary object of the present invention to provide a new and improved construction of an apparatus and method for supplying printed products to a continuously operating processing line which does not exhibit the aforementioned drawbacks and shortcomings of the prior art construction.

Another and more specific object of the present invention aims at providing a new and improved construction of an apparatus and method of the previously mentioned type in which the stack spaces or chutes can in principle be supplied with printed products or folded signatures for long time intervals without increasing the size of the stack spaces or chutes and without altering their arrangement which is essentially determined by the processing line, while the printed products or signatures can be made ready or prepared in suitable formations for supplying the stack spaces or chutes at a location remote from the stack spaces or chutes.

Yet a further significant object of the present invention aims at providing a new and improved apparatus of the character described which is relatively simple in construction and design, extremely economical to manufacture, highly reliable in operation, not readily subject to breakdown and malfunction and requires a minimum of maintenance and servicing.

Now in order to implement these and still further objects of the invention, which will become more readily apparent as the description proceeds, the apparatus of the present invention is manifested by the features that it comprises power or drive means for the feed mechanism and a plurality of transportable winding frames for interchangeably accommodating or supporting coils or wound packages of interrelated or mutually identical printed products or signatures, each coil or wound package of the coils or wound packages having an unwinding direction. Each winding frame of the plurality of winding frames accommodates or supports one coil or wound package of the coils or wound packages and can be operatively associated with or positively positioned in front of a related one of the feed mechanisms. Drive and conveying means are provided for each winding frame for driving the coil or wound package in the unwinding direction and for conveying the printed products or signatures unwinding from the coil or wound package to the related feed mechanism, and coupling means serve for coupling the drive and conveying means of the winding frames to the drive or power means of the related feed mechanism to which an associated one of the winding frames is connected.

It will be understood that the terms "coil of printed products" or "wound package of printed products" relate to a formation for storing printed products which can, for instance, be produced by the apparatus described in the German Patent Publication No. 3,123,888 and the corresponding British Patent Publication No. 2,081,230. This formation is in principle a spirally wound imbricated formation with a winding band or separator or partitioning strap wound up between the coil layers of the wound package and serving to hold the wound package together.

Since the drive and conveying means of a winding frame connected to a related feed mechanism are coupled to the drive of such feed mechanism according to the present invention, the product feed to the stack spaces takes place in proportion to the drive speed of the corresponding feed mechansim.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 schematically shows an end view of an apparatus according to the invention associated with a collective stapler or binder device of a processing line;

FIG. 2 schematically shows a plan view of a portion of FIG. 1 in which one winding frame carrying a full wound package is about to be operatively associated with or connected to the feed mechanism of one of the stack spaces;

DETAILED DESCRIPTION OF THE PREFERRED EMBODIMENTS

Figure 3:
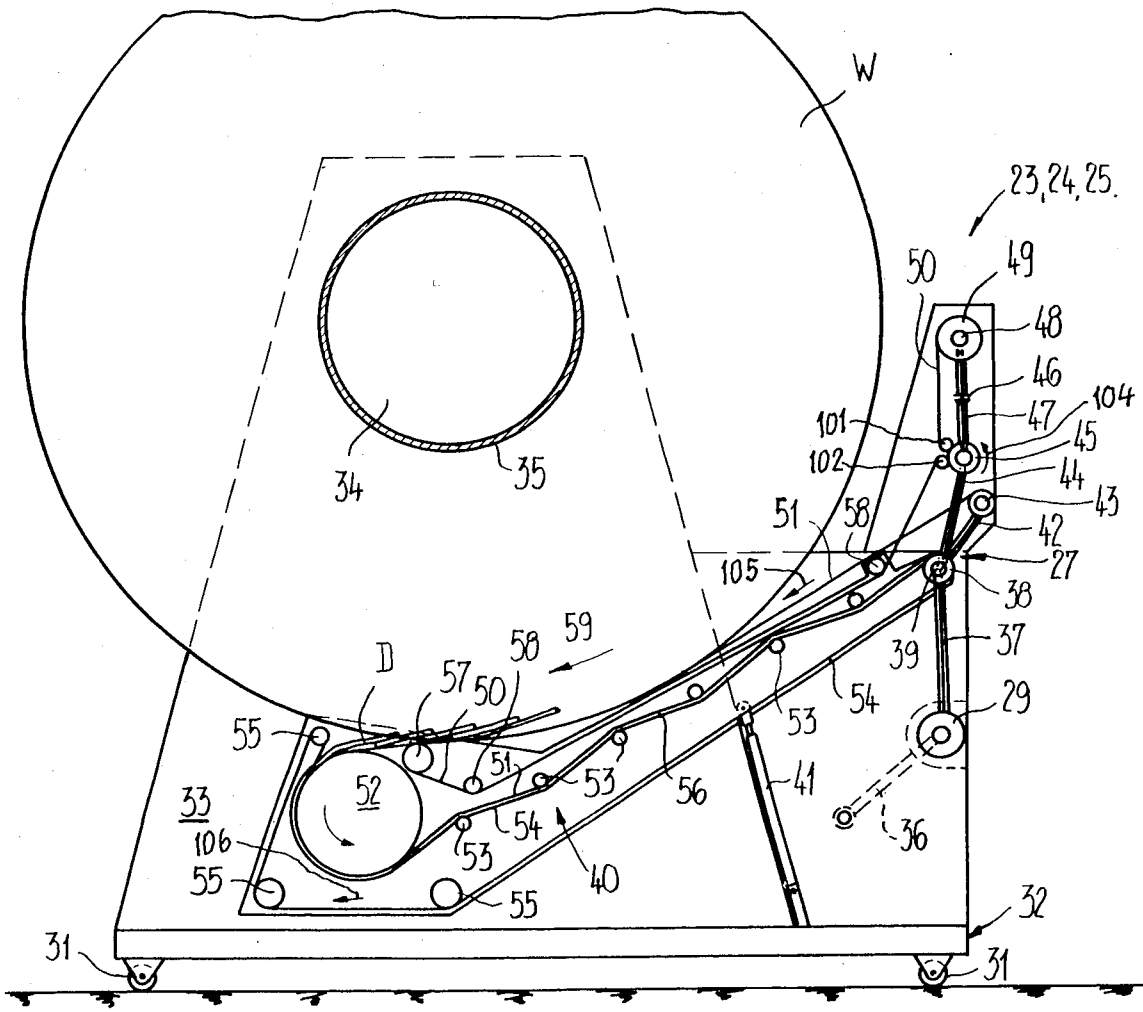
FIG. 3 schematically shows a side view of a winding frame carrying a full wound package on an enlarged scale and with indication of its drive and conveying means.

Describing now the drawings, it is to be understood that to simplify the showing thereof only enough of the structure of the apparatus for supplying printed products to a continuously operating processing line has been illustrated therein as is needed to enable one skilled in the art to readily understand the underlying principles and concepts of this invention. Turning now specifically to FIG. 1 of the drawings, the apparatus 10 illustrated therein by way of example and not limitation will be seen to adjoin an only schematically indicated collective stapler or binder device 11. It will be understood that the association with a collective stapler or binder device 11 is only presented as an example and that the apparatus of the present invention could equally well be associated with a signature collator or printed product collector device or with practically any other device normally included in a printed product processing line.

The apparatus 10 comprises a plurality of stack spaces or chutes 12, 13, 14 and so forth arranged in relatively dense arrangement along the collective stapler 11, only the stack spaces or chutes 12, 13 and 14 of which are here conveniently shown. The stack spaces or chutes 12, 13 and 14 are provided with conventional feed means or mechanisms 15, 16 and 17 respectively, which serve to retard or dam-up printed products or signatures arriving in an imbricated flow to form reclining stacks 18, 19 and 20 respectively, of standing or upright printed products or signatures and to feed these stacks constantly toward a singling and supply device 100 incorporated in the collective stapler 11. Such feed means are, for instance, disclosed in the U.S. Pat. No. 3,700,232, granted Oct. 24, 1972 or in the German Patent Publication No. 2,421,271, in full detail, and the disclosure of which is incorporated herein by reference. Each of these feed means or mechanisms 15, 16 and 17 is individually driven or powered. This is indicated schematically in FIG. 1 where an electric drive motor 21 for the feed mechanism 17 is shown. The electric drive motor 21 drives the not particularly shown movable elements of the feed mechanism 17 through a countershaft 22 only schematically represented in FIG. 1. It is essential that a component of the countershaft 22, for instance a gear 23', be accessible from the side of the feed mechanism 17 facing away from the collective stapler 11. The indications just given in relation to the feed mechanism 17 analogously apply to the other feed mechanisms 15 and 16 as well.

Figure 4:
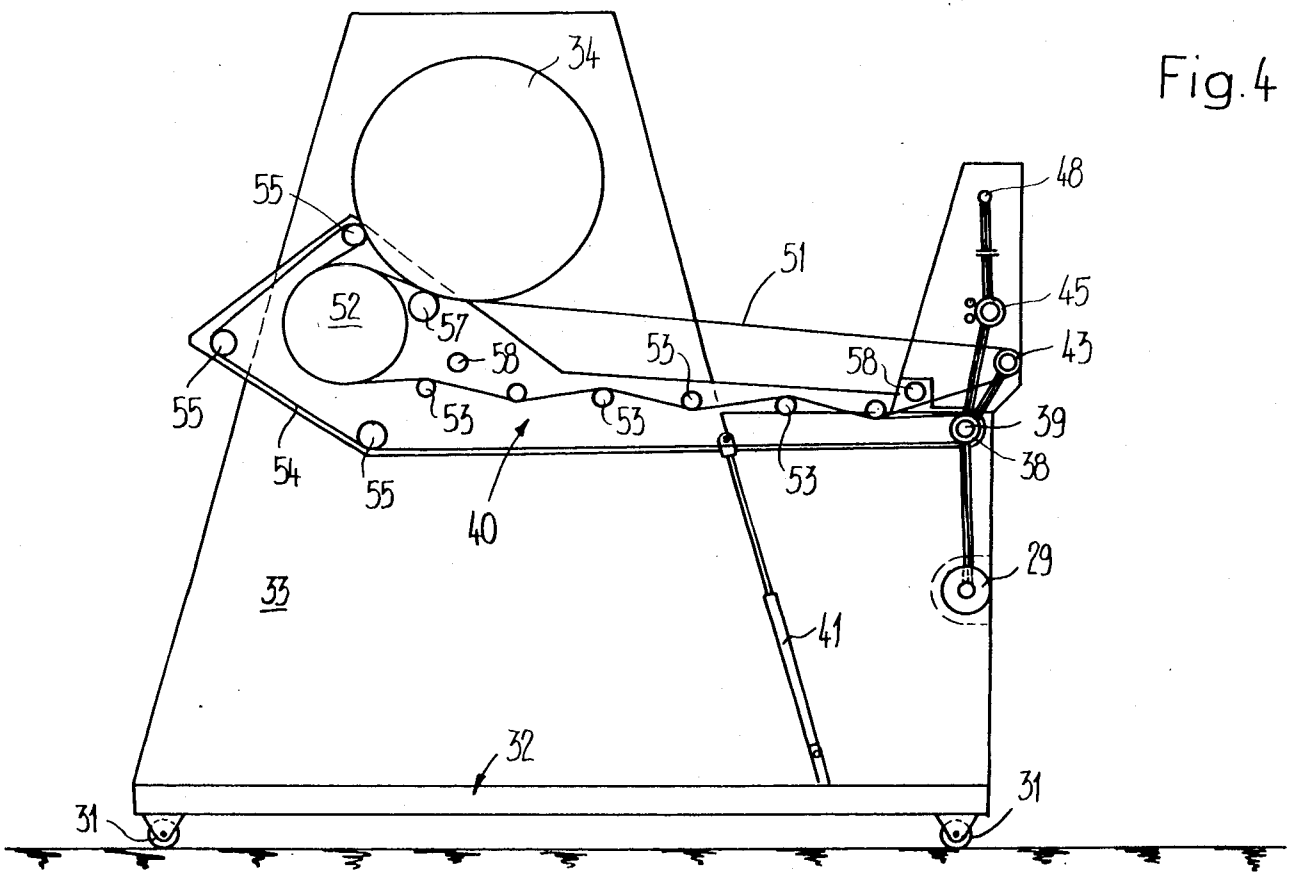
FIG. 4 schematically shows a side view of an empty winding frame at the scale of FIG. 3 and wherein the drive and conveying means of the winding frame are only very schematically indicated.

A transportable winding frame to be described in more detail in relation to FIGS. 3 and 4 can be operatively associated with each of the feed mechanisms 15, 16 and 17 and therefore with each stack space or chute 12, 13 and 14 respectively, in the way that a ferry boat docks stern-to at a pier. Three such winding frames 23, 24 and 25 are conveniently shown by way of example in FIG. 2. The winding frame 24 is about to be docked to the stack space or chute 13, while the winding frames 23 and 25 are represented in the operatively associated state.

The winding frames 23, 24 and 25 serve to exchangeably or interchangeably accommodate printed product coils or wound packages W and are provided with drive and conveying means 26 only summarily indicated in FIG. 1. The drive and conveying means 26 serve to drive the associated coil or wound package W in the product unwinding direction about an axis of rotation and to transport or convey the printed products or signatures thereby unwinding from the coil or wound package W to a transfer location 27. The axis of rotation of each one of the printed product coils or wound packages W is arranged in the related winding frames 23, 24 and 25 to extend in a direction substantially parallel to the direction of extent of the processing line when operatively associated with a selected one of the feed mechanisms 15, 16 and 17. The transfer location 27 is arranged at the same height as and, in the docked state of the corresponding winding frame 23 or 25, directly in front of an inlet region 103 of the related feed mechanism 15 or 17, respectively, of the stack space or chute 18 or 20, respectively.

The drive and conveying means 26 are driven, for instance, by a chain transmission or drive 28 fixedly mounted in the related winding frame 23, 24 or 25 itself and initially only schematically indicated in FIG. 1. The chain transmission 28 comprises a first component formed by a gear 29. The gear 29 is arranged on the same side of the associated winding frame as the transfer location 27 of such winding frame at the same height as the gear 23' and is freely accessible. Therefore the gear 29 positively engages with the gear 23' driven by the electric drive motor 21 when the related winding frame is docked. This produces not only the advantage that the speed with which the drive and conveying means 26 operates is adapted to that of the associated feed mechanism, but also that the winding frames 23, 24 and 25 require no active drive means of their own. The rotational speed of the drive motor 21 is advantageously regulatable in order to be able to adapt the rotational speed of the drive motor 21 to the operating speed and the operational requirements of the collective stapler 11.

The inlet regions 103 of the feed mechanisms 15, 16 and 17 are each flanked by a pair of guide columns 30. These guide columns 30 accurately define the position of a winding frame 23, 24 and 25 in the longitudinal direction of the collective stapler 11 when a related winding frame 23, 24 and 25 approaches the collective stapler 11. This orients the associated transfer location 27 toward the appropriate feed mechanism 15, 16 or 17 and orients the gears 29 and 23' with respect to one another.

In FIGS. 3 and 4, and particularly in FIG. 3, one of the winding frames 23, 24 and 25 is seen from the side. Its base plate 32 is supported by rollers 31 upon the floor and, in turn, supports a box frame 33 only essentially indicated in its outer contours. A bearing or journalling means 34 only indicated by a circle is mounted on the box frame 33 in its upper region. A printed product coil or wound package W is exchangeably insertable into the bearing or journalling means 34 conjointly with its winding core or mandrel 35 in such manner that the printed product coil or wound package W is, in principle, freely rotatable.

The gear 29 is also visible in FIG. 3. A manually operatable crank 36 (indicated in dotted line) is seated or mountable on a shaft **29*a* of the gear 29** from the side facing the observer.

The drive connections emanating from the gear 29 are represented in triple full lines in FIG. 3 for the sake of simplicity. The first drive connection 37 leads to a deflecting or turning roll 38 which is rotatable upon a shaft 39. The shaft 39 is simultaneously the pivot point of a rocker or balance arm 40 in which—as will be hereinbelow described—a system of conveyor belts is mounted. The rocker or balance arm 40 is supported on the base plate 32 by a gas spring element 41. The gas spring element 41 is sized such that it is just able to compensate the weight of the rocker or balance arm 40 pivoted at the location 39 as well as the components mounted therein. A drive connection 42 extends from the deflecting or turning roll 38 to a further deflecting or turning roll 43. A drive connection 44 extends from the deflecting roll 38 to a capstan roll 45 cooperating with two pressure or contact rolls 101 and 102. A drive connection 47 equipped with a slip clutch 46 extends from this location to a winding mandrel or core 48 which accommodates a bobbin or core 49 for the winding band or strap 50 previously mentioned in connection with the concept of the "printed product coil" or "wound package".

The deflecting roll 43 is wrapped or partially surrounded by a conveyor belt 51 which leads to the periphery or circumference of the printed product coil or wound package W, then around a larger deflecting or turning roll 52 and thence through an extended zig-zag path determined by freely rotatable guide rolls 53, past the upper side of the deflecting roll 38 and back to the deflecting roll 43. The deflecting roll 38 is wrapped or partially surrounded by a conveyor belt 54 which initially leads around three freely rotatable deflecting or turning rolls 55, then wraps around the larger deflecting roll 52 in the same direction as the conveyor belt 51 and thence into the same extended zig-zag path determined by the guide rolls 53 and back to the deflecting roll 38. Where both conveyor belts 51 and 54 have a common path, namely around a portion of the deflecting roll 52 and then in the previously mentioned zig-zag path, they delimit a conveying gap 56 which ends at the deflecting roll 38. This terminal location simultaneously constitutes or defines the previously mentioned transfer location 27 of the related winding frame 23, 24 and 25. A freely rotatable withdrawal roll 57 is mounted immediately before the deflecting roll 52 within the rocker or balance arm 40 for peeling off the previously mentioned winding band or strap 50 from the printed product coil or wound package W. The winding band or strap 50 then leads over deflecting roll 58 and around the capstan roll 45 to the winding band or strap take-up bobbin or core 49.

From the previous description it will be clear that as soon as the shaft 29*a* of the gear 29 is driven or powered (whether by the gear 29 or by the crank 36), the capstan roll 45 and both conveyor belts 51 and 54 are driven in the direction of the arrows 104, 105 and 106, respectively. The capstan roll 45 pulls the winding band or strap 50 of the printed product coil or wound package W and therefore sets the latter into rotation in the clockwise unwinding direction as seen in FIG. 3 (cf. arrow 59). The printed products or signatures D thus exposed are taken up by the conveying gap 56 between the conveyor belts 51 and 54 and are conveyed or transported to the related transfer location 27. Since the drive and conveying means constituted by the gear 29 and the conveyor 26 are devoid of a motor and are reliant upon the motor 21 of the stations for actuation, these drive and conveying means constitute stand-by drive and conveying means.

During removal of printed products, the diameter of the printed product coil or wound package W gradually decreases. The gas spring element 41 ensures that the rocker or balance arm 40 is appropriately lifted, so that the conveyor belt 51 and the withdrawal roll 57 always remain in contact with the periphery or circumference of the printed product coil or wound package W. However, the aforementioned transfer location 27 always remains at the same height.

An empty winding frame 23, 24 or 25 is represented in FIG. 4. The rocker or balance arm 40 bears against the now empty bearing or journalling means 34 due to the action of the gas spring element 41. To load the winding frame 23, 24 or 25 shown in FIG. 4, it suffices to pivot the rocker or balance arm 40 downward and then to install a full printed product coil or wound package W together with its winding core direction extending away from the observer by means of a suitable lifting means, while analogously installing an empty winding band or strap take-up bobbin or core 49 upon the winding mandrel or core 48. Then the excess length of the winding band or strap 50 present on the periphery or circumference of the full printed product coil or wound package W is released, and conducted around the withdrawal roll 57 and the deflecting rolls 58 as well as around the capstan roll 45 up to the installed winding band or strap take-up bobbin or core 49. Then the shaft 29*a* of the gear 29 is, for instance, manually rotated. The excess length of the winding band or strap 50 is thereby wound up, which sets the printed product coil or wound package W into rotation. The conveyor belts 51 and 54 also move but the conveying gap 56 lying therebetween will only receive printed products for being transported or conveyed further when the last coil layer of the winding band or strap 50 still situated upon the periphery or circumference of the printed product coil or wound package W begins to be unwound. Then the shaft 29*a* of the gear 29 is further rotated until the first printed product has passed through the conveying gap 56 (cf. FIG. 3) and practically appeared at the transfer location 27, i.e. above the deflecting roll 38. Now the winding frame 23, 24 or 25 is ready to be operatively associated with one of the related stack spaces or chutes 12, 13 or 14 (cf. FIG. 2).

The apparatus of the present invention advantageously comprises a greater number of winding frames 23, 24 and 25 than there are stack spaces or chutes 12, 13 and 14 in service, preferably twice as many. Then there is namely one winding frame 23, 24 or 25 operatively associated with each related stack space or chute 12, 13 or 14 and a corresponding empty winding frame 23, 24 or 25 can be provided—even at a spatially remote location—with a new full printed product coil or wound package W and subsequently transported into the proximity of its future service location. The time which elapses while exchanging a printed product coil or wound package W which has become empty at a stack space or chute 12, 13 or 14 together with its winding frame 23, 24 or 25 by a new winding frame 23, 24 or 25 provided with a full printed product coil or wound package W is too short, and in any case not sufficient, to allow depletion of the supply of printed products still present in the stacks 18, 19 and 20. The continuous operation of the collective stapler or binder 11, or more generally of the processing line, is therefore ensured.

It will be understood that the capacity of a printed product coil or wound package W can easily amount to 10 or 20 times that of one of the stack spaces or chutes 12, 13 and 14, so that sufficient time remains for relatively few operating personnel to support a great number of stack spaces 12, 13 and 14. The apparatus of the present invention provides a further advantage in that the winding frames 23, 24 and 25 are transportable or mobile, which has the result that the loading of the winding frames 23, 24 and 25 with full printed product coils or wound packages W can be performed at a remote location.

The rolls or rollers 31 can be arrestable or constructed as steering or guide rolls or rollers or both. Not particularly shown conventional quick coupling means can also be provided between the housings of the feed mechanisms, on the one hand, and the winding frames 23, 24 and 25, on the other hand, in order to arrest or lock the latter in connected position.

While there are shown and described present preferred embodiments of the invention, it is to be distinctly understood that the invention is not limited thereto, but may be otherwise variously embodied and practiced within the scope of the following claims. Accordingly,

What I claim is:

1. An apparatus for supplying products to a continuously operating processing line, especially for supplying printed signatures to a collector device, comprising:

a plurality of stack spaces for accommodating one stack each of substantially mutually identical printed products to be supplied to the processing line;

a supply device for transferring said printed products singly to said processing line;

a powered feed mechanism provided for each said stack space for feeding an associated one of said stacks to said supply device;

drive means for each said feed mechanism;

a plurality of transportable winding frames for exchangeably supporting wound packages of said substantially mutually identical printed products;

each wound package of said wound packages having an outer periphery and an unwinding direction;

each winding frame of said plurality of winding frames supporting one wound package of said wound packages and being operatively associatable with a selected one of said feed mechanisms;

stand-by drive and conveying means mounted in each of said winding frames for contactingly driving said wound package at said outer periphery in said unwinding direction and for conveying said printed products unwinding from said wound package to said selected feed mechanism; and coupling means for coupling said stand-by drive and conveying means of said winding frames to said drive means of the selected one of said feed mechanisms with which a related one of said winding frames is operatively associated for activating said stand-by drive and conveying means.

2. The apparatus as defined in claim 1, wherein:

each of said transportable winding frames has rollers upon which said transportable winding frames are mobile.

3. The apparatus as defined in claim 2, wherein:

said rollers comprise arrestable rollers.

4. The apparatus as defined in claim 2, wherein:

said rollers comprise steering rollers.

5. The apparatus as defined in claim 1, further including:

operating means provided for each said winding frame for manually operating said drive and conveying means of said winding frame.

6. The apparatus as defined in claim 5, wherein:

said operating means comprise a crank.

7. The apparatus as defined in claim 1, further including:

an accessible drive member provided for each said feed mechanism; and an accessible drive member provided for each said stand-by drive and conveying means of said winding frames and capable of being brought into positive engagement with said accessible drive member of the feed mechanisms.

8. The apparatus as defined in claim 1, wherein:

each said wound package defines an axis of rotation;

said processing line having a direction of extent; and said axis of rotation extending substantially parallel to said direction of extent when an associated one of said winding frames is operatively associated with one of said feed mechanisms.

9. The apparatus as defined in claim 1, wherein:

said plurality of winding frames is greater in number than said plurality of stack spaces.

10. The apparatus as defined in claim 7, wherein:

said stand-by drive and conveying means of each said winding frame defines a transfer location;

each said transfer location being arranged at a substantially constant height;

each said feed mechanism having an inlet region; and each said transfer location being situated immediately before said inlet region when said winding frame is operatively associated with a selected one of said feed mechanisms.

11. The apparatus as defined in claim 10, wherein:

said transfer location of said stand-by drive and conveying means and said drive member of each said winding frame are arranged on a common side of said winding frame.

12. An apparatus for supplying printed products to a continuously operating product processing line, comprising:

at least one stack chute associated with said processing line for accommodating a substantially reclining stack of interrelated ones of said printed products;

a feed mechanism provided for said at least one stack chute for feeding said printed products of said substantially reclining stack singly to said processing line;

drive means powering said feed mechanism;

at least one mobile winding frame for exchangeably accommodating a wound package of said interrelated printed products;

said wound package having an outer periphery;

positioning means for positively positioning said at least one winding frame in operative relation to said feed mechanism of said at least one stack chute;

belt means provided in said at least one winding frame for engaging said outer periphery and unwinding said wound package and for conveying said interrelated printed products unwound from said wound package to said feed mechanism and defining a stand-by drive and conveyor means for said at least one winding frame; and coupling means for operatively engaging said belt means of said at least one winding frame with said drive means of said feed mechanism for powering said belt means.

13. The apparatus as defined in claim 12, wherein:

said drive means of said feed mechanism comprises a first accessible drive member;

said belt means of said at least one winding frame comprises a second accessible drive member; and said first and second drive members being capable of positive mutual operative engagement.

14. The apparatus as defined in claim 12, wherein:

said feed mechanism of said at least one stack chute has an inlet location situated at a predetermined height; and said belt means of said at least one winding frame defining a transfer location at said predetermined height for supplying said interrelated printed products to said feed mechanism.

15. A method of operating an apparatus for supplying printed products to a continuously operating processing line, comprising the steps of:

loading at least one transportable winding frame with a wound package of said printed products;

transporting said at least one winding frame to a processing station of said processing line;

operatively coupling said at least one winding frame to drive means of said processing station;

supplying said printed products to said processing station by unwinding said wound package at a constant peripheral speed by a drive and conveying means contactingly driving said wound package at its outer periphery;

upon exhaustion of said printed products of said wound package loaded on said at least one winding frame, exchanging said at least one winding frame for a loaded winding frame; and continuously reiterating the above method steps during operation of the processing line.

16. The method as defined in claim 15, wherein:

said step of loading is performed at a location remote from said processing line.

* * * * *

UNITED STATES PATENT AND TRADEMARK OFFICE

CERTIFICATE OF CORRECTION

PATENT NO. : 4,676,496

DATED : June 30, 1987

INVENTOR(S) : WERNER HONEGGER

It is certified that error appears in the above-identified patent and that said Letters Patent is hereby corrected as shown below:

Column 6, line 14, after "winding core" please insert --or mandrel upon the bearing or journalling means 34 in the--

Column 7, line 66, after "said" please insert --stand-by--

Column 8, line 10, please delete "mechanisms" and replace it with --mechanism--

Signed and Sealed this

Twenty-second Day of March, 1988

*Attest:*

DONALD J. QUIGG

*Attesting Officer*

*Commissioner of Patents and Trademarks*